US006389934B1

(12) United States Patent
Yen

(10) Patent No.: US 6,389,934 B1
(45) Date of Patent: May 21, 2002

(54) TWO DIRECTIONAL OPERATION WRENCH

(76) Inventor: Huey-Wen Yang Yen, No. 8, Lane 179, Kung-Chiao St., Tai-Li., Taichung (TW)

( * ) Notice: Subject to any disclaimer, the term of this patent is extended or adjusted under 35 U.S.C. 154(b) by 9 days.

(21) Appl. No.: 09/668,543

(22) Filed: Sep. 25, 2000

(30) Foreign Application Priority Data

Jun. 7, 2000 (TW) ..... 089209692

(51) Int. Cl.[7] ..... B25B 13/02
(52) U.S. Cl. ..... 81/124.3; 81/121.1; 81/186
(58) Field of Search ..... 81/124.3, 121.1, 81/124.4, 119, 186

(56) References Cited

U.S. PATENT DOCUMENTS 1,378,160 A * 5/1921 Woodville ..... 81/124.3
1,954,141 A * 4/1934 Miquelon ..... 81/186 X
6,131,492 A * 10/2000 Mai ..... 81/119

* cited by examiner

*Primary Examiner*—D. S. Meislin
(74) *Attorney, Agent, or Firm*—Charles E. Baxley

(57) ABSTRACT

A wrench includes a box end which has an elongated space defined therein and the space is defined by a periphery which includes two long sides and two short sides which are connected between the two long sides. The periphery is composed of two identical portions which are symmetrical about an axis P which passes through a mediate point on one long side and a mediate point on the other second long side. Each portion has three engaging surfaces for contacting three sides of a hexagonal object and three recesses for allowing corners of the hexagonal object being received during rotation of the box end. The box end may tighten or loosen the object without removing the box end from the object by engaging the object with either one of the two identical portions of the periphery.

2 Claims, 10 Drawing Sheets

TWO DIRECTIONAL OPERATION WRENCH

FIELD OF THE INVENTION

The present invention relates to a wrench which has a box end with an elongated space in the box end and an object can be respectively engaged with the elongated space at two extreme positions so as to be rotated clockwise and counter clockwise without removing the wrench from the object.

A conventional wrench 10 is shown in FIG. 8 and includes an open end which includes two jaws 11, 110 and a recess is defined in a throat portion between the two jaws 11, 110. The two jaws 11, 110 are designed to engage a hexagonal object 12. Another conventional wrench 100 is shown in FIG. 9 and has an open end and a box end which has a space 13 defined in the box end. A special designed inner periphery of the space 13 can engage a hexagonal object. As shown in FIG. 10, the two conventional wrenches 10, 100 allow the box end and the open end to tighten the object 12 repeatedly because of the recess which allows a corner of the object 12 being received therein while the wrench 10/100 returns to its original position. Therefore, the wrench 10/100 can tighten the object 12 without removing the open end or the box end from the object 12 and aiming the object 12 again. However, this feature is applicable only in one direction, in other words, if the object 12 is to be loosened, the open end/box end of the wrench 10/100 has to be turn to the other side and engages the object 12 again.

The present invention intends to provide a wrench having a box end wherein the object is engaged at a first position in the space of the box end when rotating clockwise, and the object is engaged at a second position in the space when rotating counter clockwise.

SUMMARY OF THE INVENTION

In accordance with one aspect of the present invention, there is provided a wrench and comprising a shank with a box end connected thereto. An elongated space is defined by a periphery in the box end and the elongated space comprises a first long side, a second long side and two short sides which are connected between the two first long side and the second long side. The periphery defining the elongated space comprises two identical portions which are symmetrical about an axis P which passes through a mediate point on the first long side and a mediate point on the second long side. Each portion of the elongated space comprises a substantial U-shaped cavity which includes one short side, a half first long side and a half second long side. Each short side has a first recess and a first engaging surface which connects an end of a periphery defining the first recess. The half first long side has a second engaging surface and a notch connected between the first engaging surface and the second engaging surface. An end of a periphery defining a second recess connects the second engaging surface. The half second long side has a third engaging surface which connects the other end of the periphery defining the first recess.

The primary object of the present invention is to provide a box end wrench that has an elongated space for a hexagonal object being engaged with two positions in the space. One position allows the object to be tightened and the other position allows the object to be loosened.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
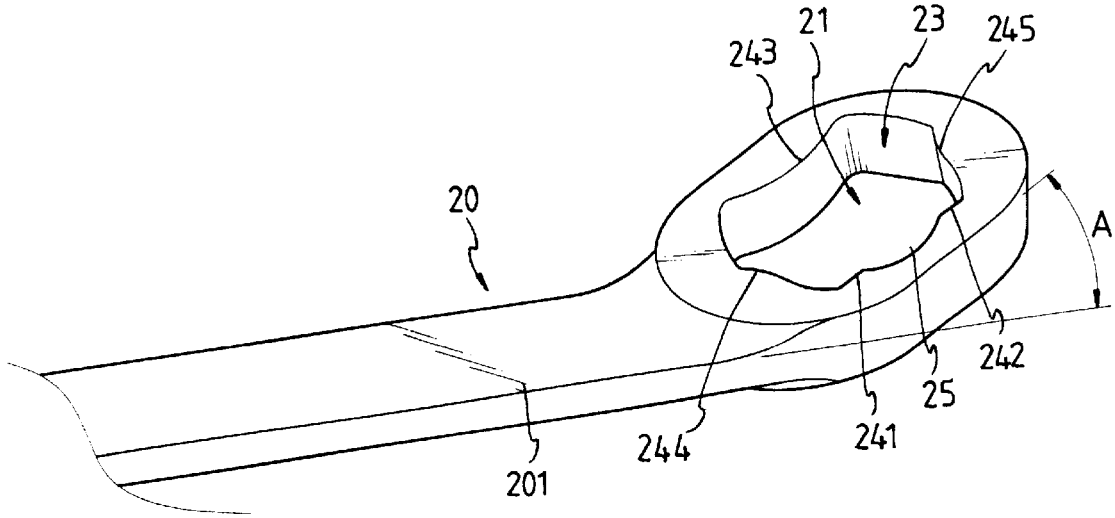
FIG. 1 is a perspective view to show a box end wrench of the present invention.
Figure 2:
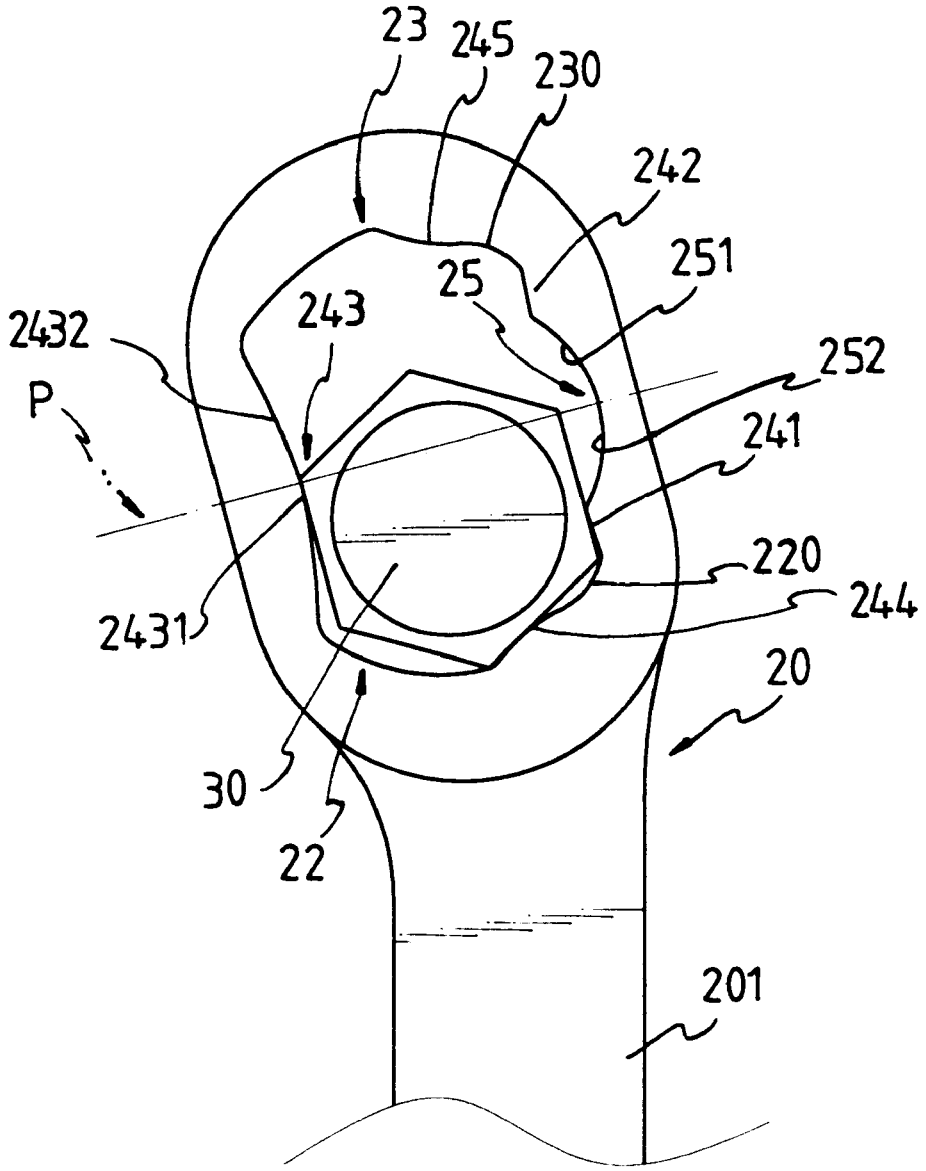
FIG. 2 is a plan view to show a hexagonal object is engaged with a first position in the space in the box end.
Figure 3:
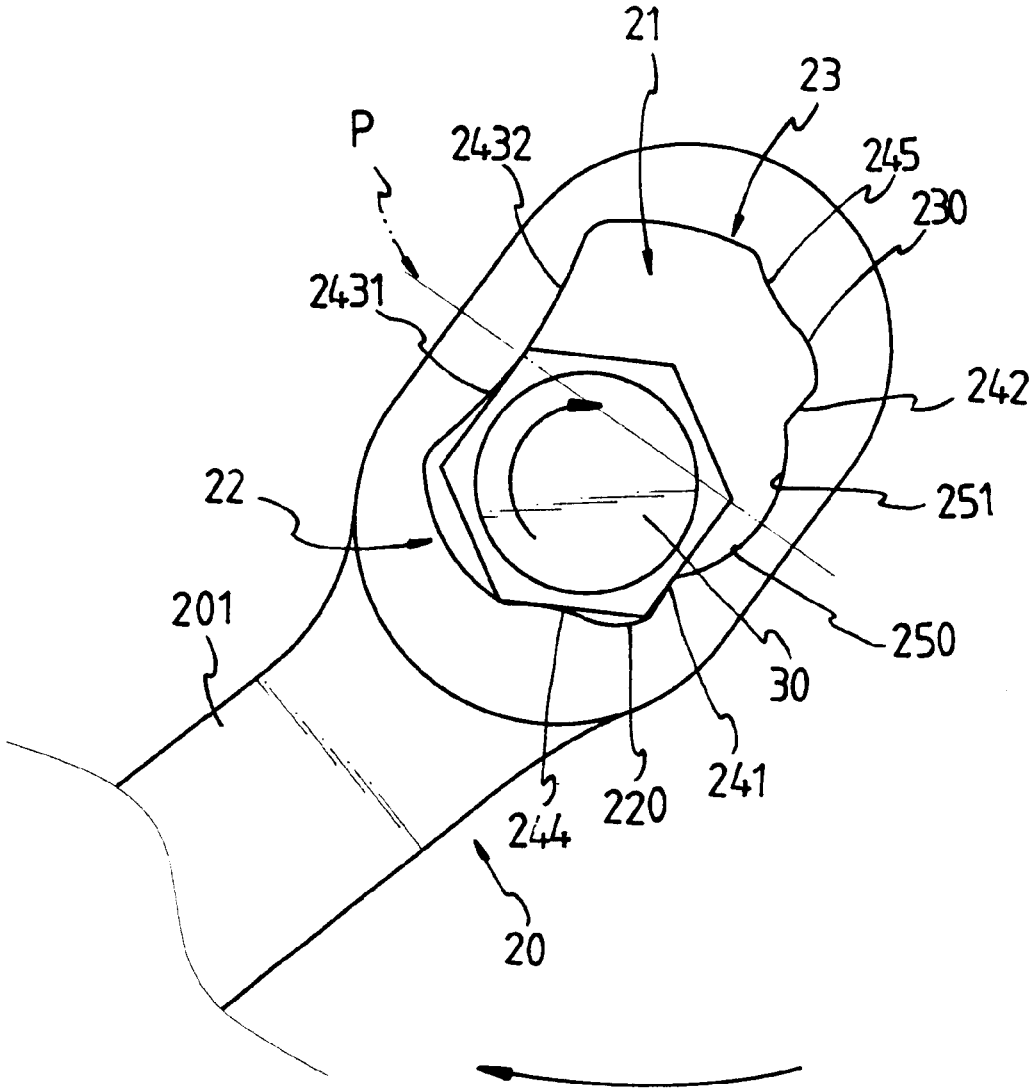
FIG. 3 is a plan view to show the hexagonal object in the first position in the box end is rotated clockwise.

Referring to FIGS. 1 to 3, the wrench 20 of the present invention comprises a shank 201 and a box end connected to an end of the shank 201. An elongated space 21 is defined in the box end and a periphery defining the elongated space 21 comprises a first long side, a second long side and two short sides which are connected between the two first long side and the second long side. The periphery defining the elongated space 21 comprises two identical portions which are symmetrical about an axis P which passes through a mediate point on the first long side and a mediate point on the second long side. Each portion of the elongated space 21 comprises a substantial U-shaped cavity which includes one short side, a half first long side and a half second long side. Each short side has a first recess 22/23 and a first engaging surface 244/245 which connects an end of a periphery defining the first recess 22/23. The half first long side has a second engaging surface 241/242 and a notch 220/230 is connected between the first engaging surface 244/245 and the second engaging surface 241/242. An end of a periphery defining a second recess 250/251 connects the second engaging surface 241/242. Therefore, the two second recesses 250, 251 are combined to be a recess 25. The half second long side has a third engaging surface 2431/2432 which connects the other end of the periphery defining the first recess 22/23. Therefore, the two third engaging surfaces 2431, 2432 are combined to be an engaging surface 243 on the second long side.

Figure 4:
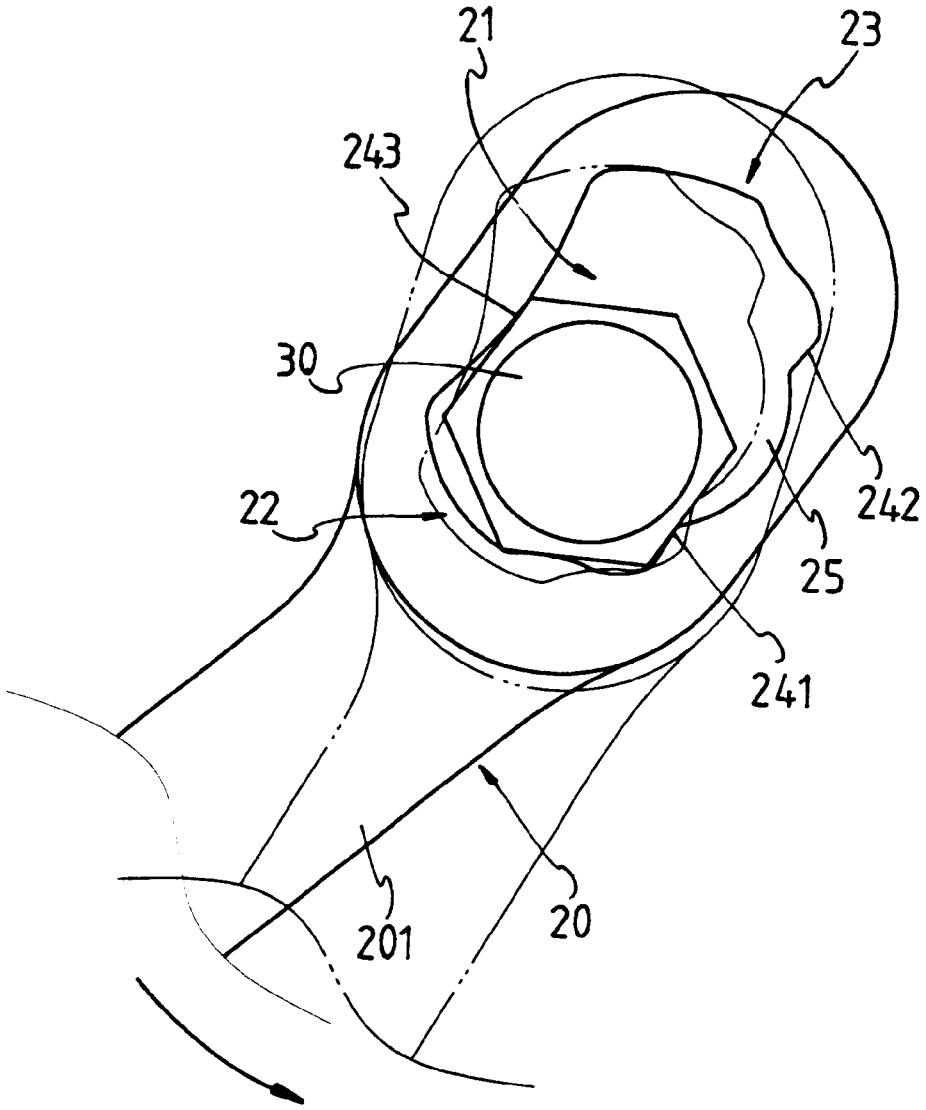
FIG. 4 shows that the box end can be reversed while the hexagonal object in the box end is remained not being rotated.
Figure 5:
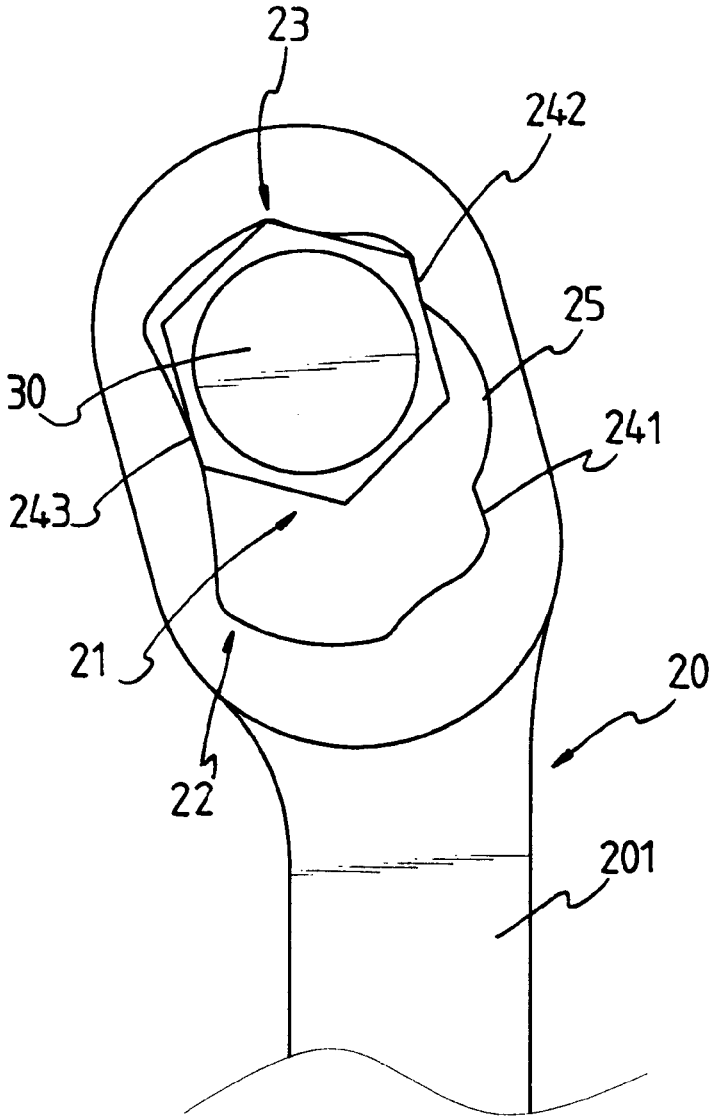
FIG. 5 is a plan view to show the hexagonal object is engaged with a second position in the space in the box end.

A hexagonal object 30 is engaged with one of the two portions at a first position in the space 21 wherein three sides of the object 30 respectively contact the first engaging surface 244, the second engaging surface 241, and the third engaging surface 2431. The box end can be rotated clockwise as shown in FIG. 3 to tighten the object 30. The box end can be reversed as shown in FIG. 4 while the corners of the object 30 are received in the first recess 22 and the notch 220. As shown in FIG. 5, when the object 30 is to be loosened or rotated counter clockwise, the box end is shift to let the object 30 be engaged with the other portion at a second position in the space 21. Because the two portions are identical so that the object 30 can be clamped in position and the object 30 can be rotated counter clockwise. The box end extends away from the shank 201 and an angle "A" is defined between a plane on which the shank 201 is located and a plane on which the box end is located. By this way, the shank 201 can be located higher than the objects and such a designed is helpful when using the wrench in a narrow space.

Figure 6:
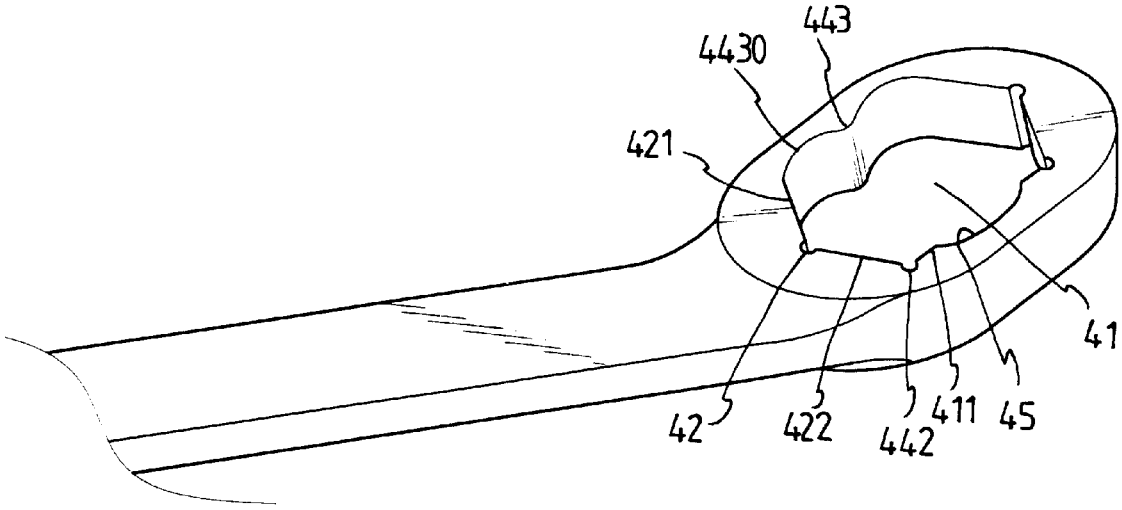
FIG. 6 is a perspective view to show another embodiment of the box end wrench of the present invention.
Figure 7:
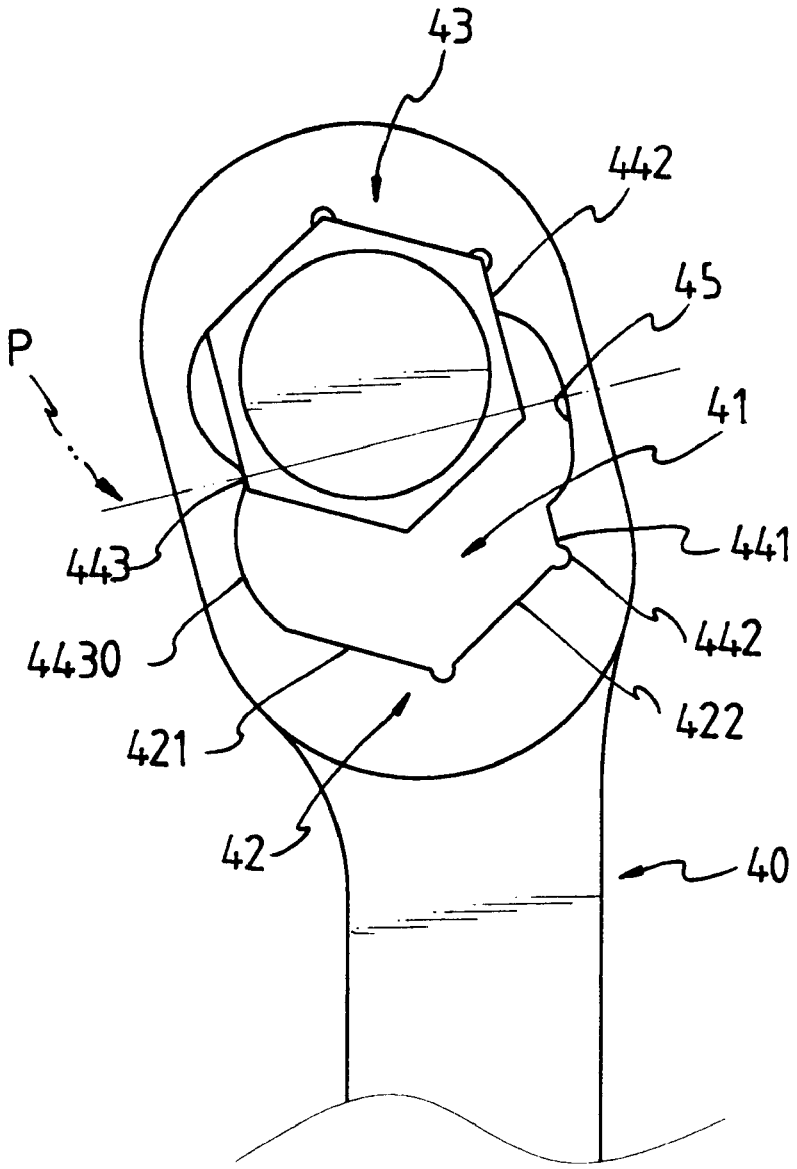
FIG. 7 is a plan view to show a hexagonal object is engaged with the space in the box end as shown in FIG. 6.
Figure 8:
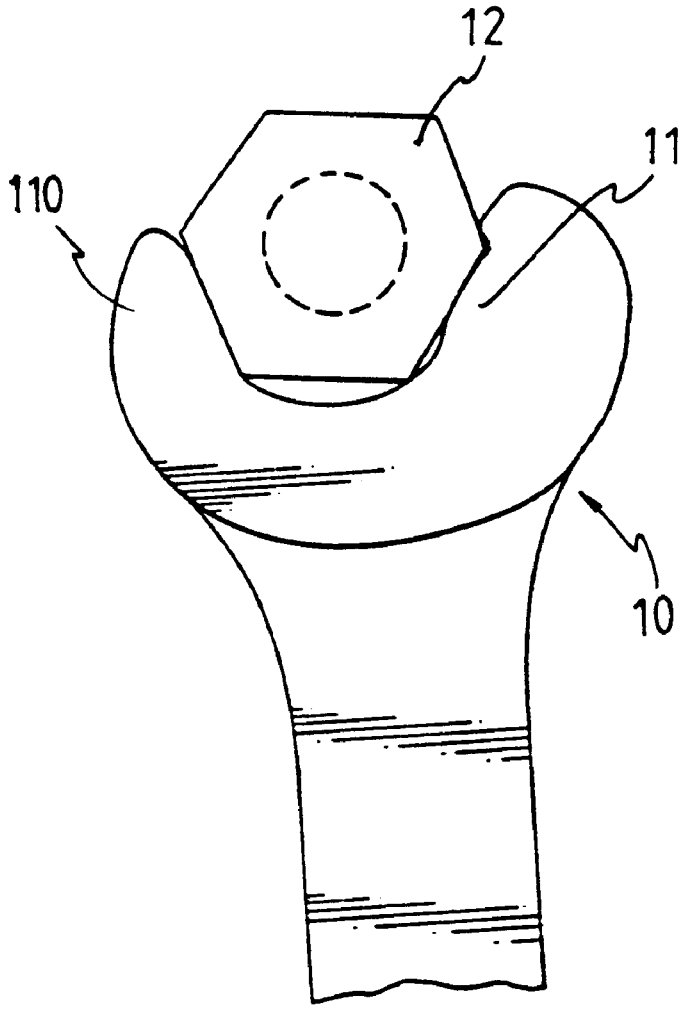
FIG. 8 shows a first embodiment of a conventional open end wrench.
Figure 9:
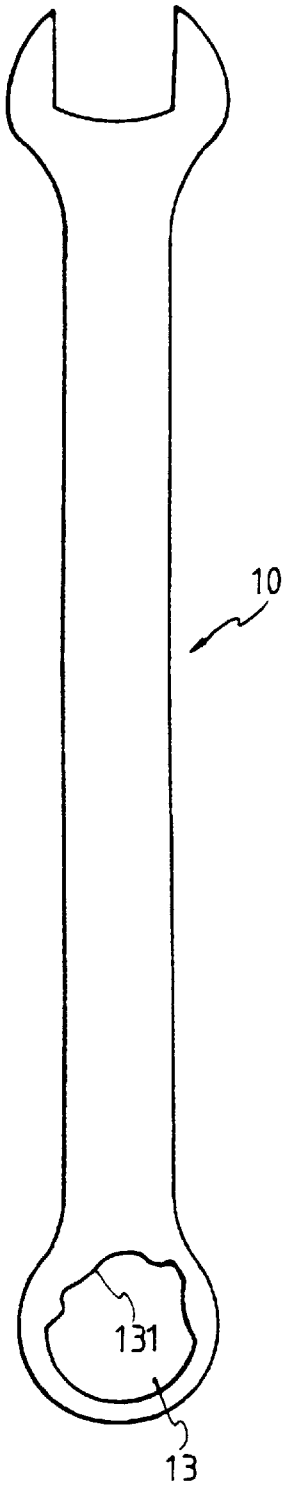
FIG. 9 PRIOR ART
FIG. 9 shows a second embodiment of a conventional wrench with an open end and a box end.
Figure 10:
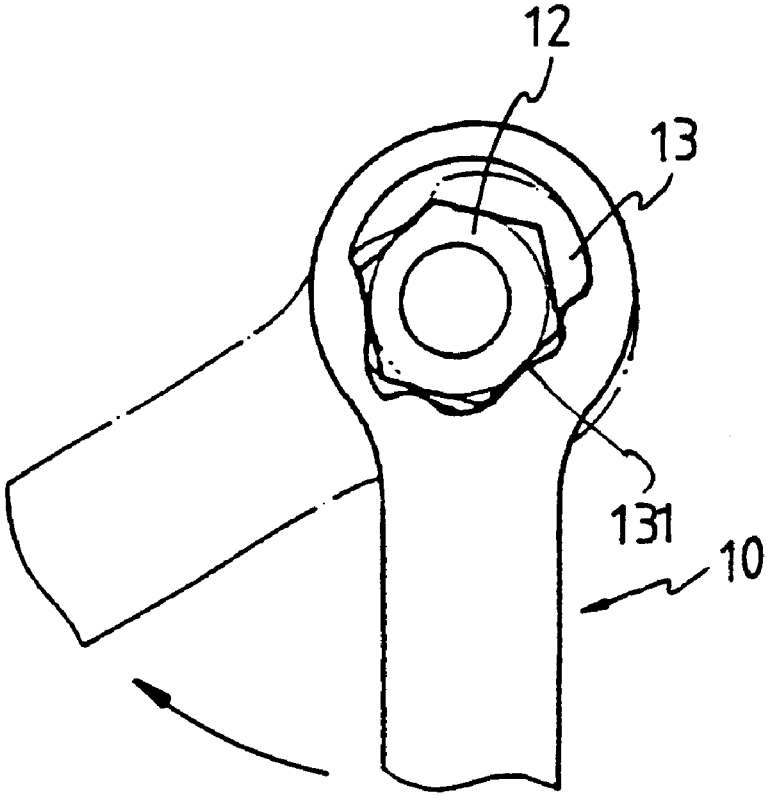
FIG. 10 PRIOR ART
FIG. 10 shows that the conventional box end wrench is operated to rotate an object in the box end.

FIGS. 6 and 7 show a second embodiment of the wrench wherein each of the two identical portions symmetrical about the axis P of the space 41 has a short side having two surfaces 421, 422 with a notch 42 connected therebetween and a 60 degrees angle is clamped between the two surfaces 421, 422. The two surfaces 421, 422 and a notch 42 are located at a bottom portion of the U-shaped cavity of each portion. The half first side has an engaging surface 441 and two recesses 45, 442 are located at two ends of the engaging surface 441. The half second long side has a recess 4430 and an engaging surface 443.

While we have shown and described various embodiments in accordance with the present invention, it should be clear to those skilled in the art that further embodiments may be made without departing from the scope and spirit of the present invention.

What is claimed is:

1. A wrench comprising:

a shank and a box end connected to an end of said shank, an elongated space defined in said box end and a periphery defining said elongated space comprising a first long side, a second long side and two short sides which are connected between said two first long side and said second long side, said periphery defining said elongated space comprising two identical portions which are symmetrical about an axis P which passes through a mediate point on said first long side and a mediate point on said second long side, each portion of said elongated space comprising a substantial U-shaped cavity which includes one short side, a half first long side and a half second long side, each short side having a first recess and a first engaging surface which connects an end of a periphery defining said first recess, said half first long side having a second engaging surface and a notch connected between said first engaging surface and said second engaging surface, an end of a periphery defining a second recess connecting said second engaging surface, said half second long side having a third engaging surface which connects the other end of said periphery defining said first recess.

2. The wrench as claimed in claim 1, wherein said box end extends away from said shank and an angle is defined between a plane on which said shank is located and a plane on which said box end is located.

* * * * *